US010676928B2

(12) United States Patent
Smith

(10) Patent No.: US 10,676,928 B2
(45) Date of Patent: Jun. 9, 2020

(54) PREFABRICATED BUILDING PANEL

(71) Applicant: EASI-SET WORLDWIDE

(72) Inventor: Rodney I. Smith, Midland, VA (US)

(73) Assignee: Easi-Set Worldwide, Midland, VA (US)

( * ) Notice: Subject to any disclaimer, the term of this patent is extended or adjusted under 35 U.S.C. 154(b) by 0 days.

(21) Appl. No.: 16/287,538

(22) Filed: Feb. 27, 2019

(65) Prior Publication Data

US 2019/0194942 A1 Jun. 27, 2019

Related U.S. Application Data

(63) Continuation of application No. 14/613,942, filed on Feb. 4, 2015, now abandoned.

(51) Int. Cl.
*E04C 2/34* (2006.01)
*E04C 2/04* (2006.01)

(52) U.S. Cl.
CPC ..... *E04C 2/34* (2013.01); *E04C 2/049* (2013.01); *E04C 2002/3488* (2013.01)

(58) Field of Classification Search
CPC ..... E04C 2/049; E04C 2/34; E04C 2002/3488
USPC ..... 428/223; 52/414
See application file for complete search history.

(56) References Cited

U.S. PATENT DOCUMENTS 2,150,898 A * 3/1939 Ackley ..... E04B 1/76 52/262
2,691,433 A * 10/1954 Farrier ..... E04B 9/0485 52/794.1
3,881,289 A * 5/1975 Mauroner ..... B28B 19/0053 52/259
3,979,864 A * 9/1976 Tillie ..... E04C 2/041 52/126.3
4,185,437 A * 1/1980 Robinson ..... E04C 2/384 264/256
4,286,420 A * 9/1981 Pharmakidis ..... E04B 1/74 52/404.1
4,558,552 A * 12/1985 Reitter, II ..... E04B 2/56 156/91
4,619,032 A * 10/1986 Sudrabin ..... E04B 1/04 264/263
4,768,322 A * 9/1988 Kafarowski ..... E04F 13/144 403/379.3
4,856,244 A * 8/1989 Clapp ..... E04C 2/386 52/309.7
4,930,278 A * 6/1990 Staresina ..... E04C 2/28 52/315
4,998,393 A * 3/1991 Baena ..... E04B 1/161 52/236.9

(Continued)

*Primary Examiner* — Patrick J Maestri
*Assistant Examiner* — Joseph J. Sadlon
(74) *Attorney, Agent, or Firm* — W & C IP

(57) ABSTRACT

Prefabricated building panels combine new and unexpected element dimensions and materials with the effect of reducing overall weight and depth while simultaneously improving panel performance such as thermal insulation. As compared to former panels, prefabricated building panels according to exemplary embodiments of the invention generally include thinner concrete slabs, wider separations between concrete and support framing, and new material choices for anchors connecting slabs with framing. Exemplary panels are compliant with energy codes such as the latest ASHRAE and IECC.

19 Claims, 1 Drawing Sheet

(56) References Cited

U.S. PATENT DOCUMENTS 5,332,863 A * 7/1994 Emmert ..... E04B 7/028 174/481
5,372,769 A * 12/1994 Ryberg ..... B28B 23/0068 264/254
5,440,845 A * 8/1995 Tadros ..... E04C 2/044 52/309.12
5,699,644 A 12/1997 Smith
5,758,463 A * 6/1998 Mancini, Jr. ..... E04C 2/384 52/309.12
5,799,454 A * 9/1998 Andersson ..... E04B 1/7612 52/302.3
6,026,629 A * 2/2000 Strickland ..... E04C 2/06 52/309.11
6,272,805 B1 * 8/2001 Ritter ..... E04C 2/044 52/309.11
7,168,216 B2 * 1/2007 Hagen, Jr. ..... B29C 44/186 52/480
7,627,997 B2 * 12/2009 Messenger ..... E02D 27/02 52/309.17
7,681,368 B1 * 3/2010 Rubio ..... E04C 2/044 256/31
7,845,130 B2 * 12/2010 Tonyan ..... B28B 5/027 106/735
8,122,662 B2 * 2/2012 Farrell, Jr. ..... E04C 2/044 52/371
8,397,457 B2 * 3/2013 Hauser ..... E04G 23/0218 52/344
8,534,028 B2 * 9/2013 Wojtusik ..... E04B 1/0007 52/793.1
8,555,584 B2 * 10/2013 Ciuperca ..... E04B 1/355 52/309.12
8,640,429 B1 * 2/2014 Watts ..... E04B 2/56 156/91
8,671,637 B2 * 3/2014 LeBlang ..... E04B 1/74 52/404.1
8,683,765 B2 * 4/2014 Hillers ..... H05K 9/0003 52/309.4
9,399,867 B2 * 7/2016 Di Lorenzo ..... E04C 2/382
9,574,341 B2 * 2/2017 Ciuperca ..... E04F 13/144 403/379.3
9,782,913 B2 * 10/2017 Cangiano ..... B28B 11/14
9,951,519 B2 * 4/2018 Neil ..... E04C 2/528
2004/0068948 A1 * 4/2004 Wrass ..... E04B 1/90 52/309.7

* cited by examiner

PREFABRICATED BUILDING PANEL

FIELD OF THE INVENTION

The invention generally pertains to prefabricated building panels and, more particularly, energy code compliant panels with performance improvement and cost and material reductions.

BACKGROUND

Prefabricated building panels are a popular implement in today's construction industry, especially for commercial applications. Labor time and costs associated with welding and bolting, for example, significantly increase the cost of traditional construction whereby individual materials (e.g., external siding, insulation, support framing, etc.) are generally arranged and assembled at the job site. Mixing concrete at the job site includes labor costs as well as down time to permit the concrete to set. These and similar costs have been somewhat reduced in recent years by the development and increased use of precast concrete and, in particular, prefabricated building panels which combine precast concrete with other materials such as insulation and support framing. These panels are generally built and assembled at an off site location and then transported to the construction site, ready for installation. At the job site, the panels are hoisted and moved into position on the incomplete building structure. Once in position, construction workers may then bolt and/or weld the panels to the building frame and/or floor and to one another to fix them in their final locations.

Despite the advantages identified above, known prefabricated building panels are far from ideal. Existing panels tend to be very heavy, typically in the range of 90 lbs per square foot, and in all cases require heavy machinery such as cranes to lift and maneuver at the job site. In general, the design of prefabricated building panels is a challenging puzzle of inseparable pros and cons. For example, in order to support the weight of itself and potentially other building elements (e.g., roofing, neighboring panels, etc.), the concrete must be quite thick, generally 6 or more inches. The height of many present day commercial buildings means wind speeds also become a critical consideration and further require increased material thicknesses for greater strength. While thicker concrete improves the strength of a panel, it obvious greatly increases the weight and volume of the panel, both effects being highly undesirable.

Newer energy codes for buildings, especially renovations and new construction, continue to set more stringent performance criteria. As new codes go into effect, the construction industry is faced with a need for new alternatives which strike the difficult balance of such factors as weight, size (e.g., panel thickness), thermal insulation, strength (e.g., as measured in psi or maximum incident wind speed), and material costs.

SUMMARY

New energy codes such as the latest ASHRAE and IECC are met by prefabricated building panels which combine materials with unexpected specifications (e.g., material thicknesses) and performance. These new panels represent a new class of panels with performance characteristics which only emerge from the combination of their constituent parts.

According to an exemplary embodiment, a prefabricated building panel comprises a concrete slab having a thickness equal to or less than 2 inches; a plurality of stainless steel anchors permanently imbedded in the concrete slab; framing permanently secured to the concrete slab by the plurality of stainless steel anchors for structural reinforcement, the plurality of stainless steel anchors maintaining a spacing between said concrete slab and said framing of 0.5 to 3 inches; and a continuous insulation which fills at least 0.5 to 3 inches of the spacing between the concrete slab and the framing. Other exemplary embodiments with alternative or additional features are also disclosed.

DETAILED DESCRIPTION

Prefabricated building panels are discussed herein as having two opposite and substantially parallel faces. For panels ultimately installed as part of a building exterior, an "outer face" refers to the side of a panel which faces outward from the building after installation. For most panels, the "outer face" will comprise concrete or a façade behind which is concrete. An "inner face" refers the side of the panel which faces inward toward the building interior after installation. These terms are nominal only and are not intended to limit the applications or use of the panels described herein. Panels having an "outer face" and "inner face" may be installed on a building exterior or in interior spaces of a building, where interior spaces of the building are to both sides of the panel.

Figure 1:
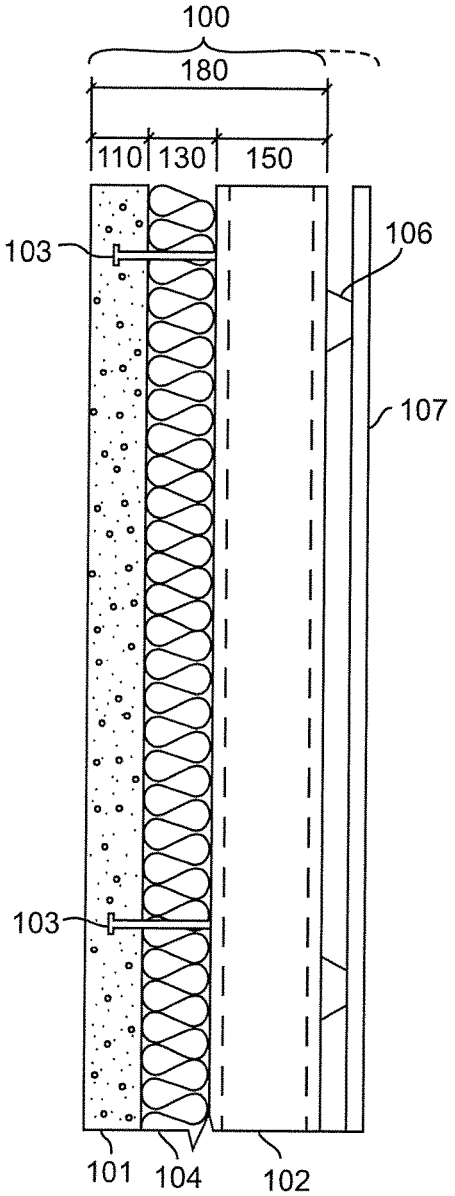
FIG. 1 is a side profile section view of a prefabricated building panel.
Figure 2:
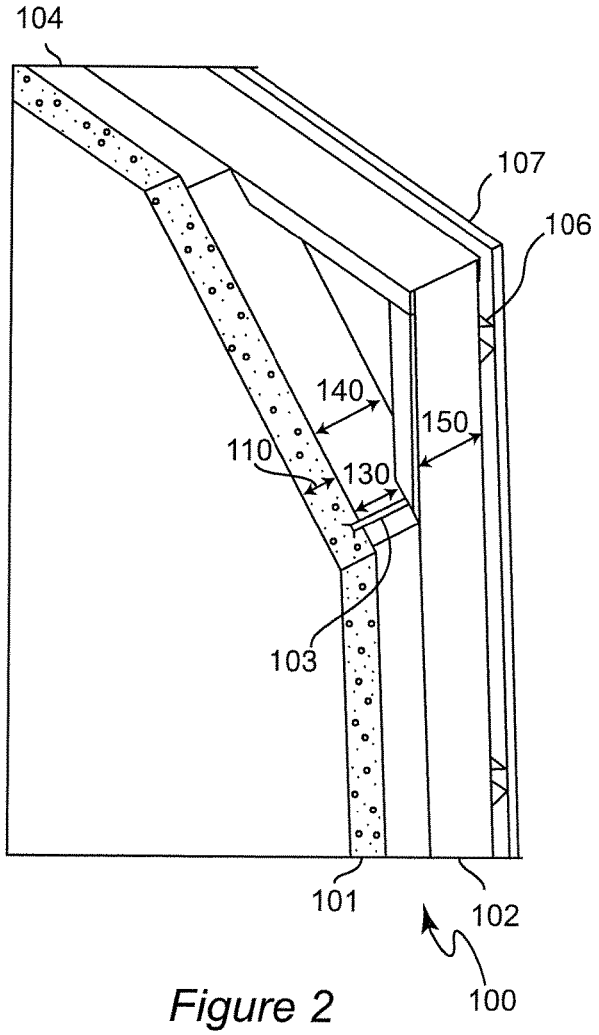
FIG. 2 is an isometric view of the prefabricated building panel shown in FIG. 1.

Referring now the drawings, and in particular FIGS. 1 and 2, there is shown a prefabricated building panel (i.e. "panel") 100. At a minimum, an exemplary panel 100 comprises at least one concrete slab 101, framing 102, anchors 103 which connect and maintain a fixed spatial relationship between the concrete slab 101 and framing 102, and insulation 104.

At a broad level, a panel 100 differs significantly from existing prefabricated building panels such as that which is disclosed by U.S. Pat. No. 5,699,644 for a number of combined features, including but not limited to: a comparatively thinner concrete slab, a comparatively wider spacing between the concrete slab and the framing, and anchors which are made of stainless steel.

In some exemplary embodiments, concrete slab 101 preferably has a thickness 110 equal to or less than 2 inches, and most preferably equal to or less than 1.5 inches (see FIG. 1). The thickness 110 may be in the range of 1.5 to 2 inches, including the particular sizes of 1.5 or 2 inches. To persons of ordinary skill in the art, such thicknesses to concrete slab 101 would be prohibited on account of their reduced strength as compared to known slab thicknesses for prefabricated building panels. However, the reduction in concrete slab thickness according to the present application has the advantageous effect of reducing the weight of the panel and thus the maximum load capacity the panel 100 must be equipped to support. In some embodiments, it is furthermore advantageous for concrete slab 101 to comprise an unusually high fiber content (e.g., glass fiber, synthetic fiber, etc.). These fiber loads are greater than fiber loads for existing prefabricated building panels. The high fiber content of concrete slabs 101 of panels 100 provides improved crack control and resistance to wind forces.

In exemplary embodiments, framing 102 may be, for example, galvanized steel studs or similar supporting members. C-shaped studs or beams are well suited for this application, but other alternatives supplying the same supportive functionality may occur to those of skill in the art and are likewise employable in the practice of the invention. In exemplary embodiments, individual studs or beams of framing 102 are assembled using automobile assembly spot-welding. Unique to panel 100 over prefabricated building panels known in the art is the feature that framing 102 comprises a plurality of parallel beams which may be spaced apart by spacing 120 at least as large as 4 feet. Older panels such as that which is disclosed by U.S. Pat. No. 5,699,644 necessitated adjacent parallel beams be spaced apart no more than 2 feet. In the older panels, separation exceeding 2 feet would generally compromise the required structural integrity of the overall panel; the reduced amount of framing would be insufficient to support the weight of the comparatively very thick concrete slabs. In light of the thinness and resulting lightness of concrete slabs 101 in panel 100, spacing 120 between adjacent beams of framing 102 may exceed 2 feet, 2.5 feet, 3 feet, 3.5 feet, up to at least 4 feet. As compared to existing panels such as that which is disclosed by U.S. Pat. No. 5,699,644, a panel 100 may also have studs or beams of framing 102 which are smaller in width 150. Width 150 of framing 102 may be 6 inches or less, 5 inches or less, or 4 inches or less. Width 150 may be in the range of 4 inches to 6 inches.

Framing 102 is permanently secured to concrete slab 101 by a plurality of anchors 103 which, in exemplary embodiments, are stainless steel. As shown in the drawings, some exemplary embodiments of a panel 100 are manufactured such that a head of each anchor 103 is permanently imbedded in the concrete of slab 101. The opposite end of each anchor 103 is welded to framing 102. In an assembled state, a panel 100 has a spacing 130 between the concrete slab 101 and the nearest framing 103 of 0.5 inch to 3 inches. In some exemplary embodiments, spacing 130 is at least 1.5 inches. In still further exemplary embodiments, spacing 130 is preferably at least 2 inches or most preferably at least 2.5 inches or more. Spacing 130 is fixed and maintained by the anchors 103, these being imbedded in the concrete slab 101 and welded to framing 102.

Known prefabricated building panels have anchors, bolts, or screws which are generally made of regular steel (i.e., not stainless steel). The provision of stainless steel anchors 103 in exemplary embodiments of the present invention is particularly advantageous over the existing art for at least the reason that stainless steel is approximately 38% less thermally conductive as compared to regular steel. As a result, there is less heat transfer between the inner face and outer face of the panel 100.

Insulation 104 is arranged between concrete slab 101 and framing 102. In exemplary embodiments, insulation 104 is a continuous insulation. The through penetration of anchors 103 through insulation 104 does not disqualify it from being accurately described as "continuous". Insulation 104 fills at least some of the spacing 130 and, in most exemplary embodiments, fills an entirety of the spacing 130. Geometrically, the thickness of insulation 104 within spacing 130 cannot exceed the span of spacing 130. However, the thickness 140 of insulation 104 (see FIG. 2) may exceed the span of spacing 130 where the insulation is partially disposed to a side of a beam (e.g., between adjacent beams) of framing 102. In FIG. 2, thickness 140 of insulation 104 is clearly greater than spacing 130, which in the illustrated embodiment is substantially filled by insulation 104. Thickness 140 may be as large as the sum of the span of spacing 130 and framing width 150.

The span of spacing 130 is unexpectedly large in contrast to existing panels such as that which is disclosed by U.S. Pat. No. 5,699,644. Owing to insulation 104 being of a thickness equal to or greater than the span of spacing 130 in exemplary embodiments, weightbearing support of the panel 100 is provided in part by the thick rigid volume of insulation 104. This reduces the maximum load which concrete slab 101 is required to bear, permitting the concrete slab to be even thinner than would be permitted with insulation having a comparative small thickness (e.g., 1 inch or less).

For some embodiments, a panel 100 may further include furring or hat channels 106 and/or gypsum board (i.e. drywall) 107. Traditional panels have an inner face consisting of only insulation and framing, and materials such as gypsum board must be installed on the job site after the panels have been maneuvered and fixed into their final positions on the building structure. In contrast, some embodiments of the present invention include channels 106 and gypsum board 107 (as is indicated by the dashed portion of the curvy bracket associated with reference numeral 100 in FIG. 1) to reduce the installation time and thus costs associated with work at the job site.

Figure 3:
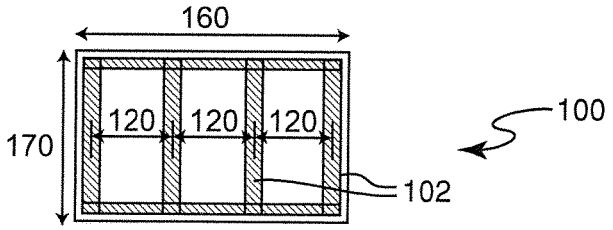
FIG. 3 is a view of an inner face of a prefabricated building panel.

Panels 100 may take a variety of dimensions, including different widths 160 and heights 170 (see FIG. 3). A particular advantage of a panel 100 is its depth 180. Generally, depth 180 is determined as the sum of the concrete slab thickness 110, the span of spacing 130, and the framing stud width 150. If, for example, these were 1.5 inches, 2.5 inches, and 4 inches, respectively, the depth 180 of the panel 100 would be 8.0 inches.

While an exemplary application of panels 100 is for exterior walls, some panels 100 or variations thereof may also be used for other purposes including but not limited to interior walls, flooring, or roofing.

While exemplary embodiments of the present invention have been disclosed herein, one skilled in the art will recognize that various changes and modifications may be made without departing from the scope of the invention as defined by the following claims.

What is claimed is:

1. A method for constructing exterior façades of buildings to comply with different climate zones thermal insulation requirements, comprising the steps of assembling a plurality of prefabricated building panels, wherein the prefabricated building panels each comprise a concrete slab having a thickness equal to or less than 2 inches, framing including a plurality of studs or beams permanently secured to the concrete slab with a spacing of 0.5 to 3.0 inches between the concrete slab and the framing, a continuous insulation which fills the spacing between the concrete slab and the framing, and a total insulation thickness equal to or greater than the spacing, wherein each of the plurality of prefabricated building panels have identical properties in terms of concrete slab, framing, and continuous insulation, including total insulation thickness, and wherein a spacing between a concrete slab and a framing of some panels of the plurality of prefabricated building panels is adjusted to be larger than a spacing between a concrete slab and a framing of other panels of the plurality of prefabricated building panels to satisfy more stringent envelope thermal insulation performance criteria.

2. The method of claim 1, wherein the framing is secured to the concrete slab by a plurality of stainless steel anchors.

3. The method of claim 1, further comprising bolting or welding the assembled prefabricated building panels to building frames.

4. The method of claim 1, wherein the spacing for said some of the plurality of prefabricated building panels is at least 2 inches, and the spacing for said other panels is 1.5 inches.

5. The method of claim 1, wherein the total insulation extends into a cavity between the webs of adjacent studs or beams of the framing.

6. The method of claim 1, wherein the thickness of the concrete slab is between 1.5 and 2 inches.

7. The method of claim 1, wherein said plurality of beams or studs are spaced apart at intervals of more than 2 feet and up to 4 feet.

8. The method of claim 1, wherein said width of each of said plurality of studs or beams is 4 to 6 inches.

9. The method of claim 1, wherein said plurality of studs or beams include C-shaped studs or beams.

10. A method for constructing exterior façades of buildings to comply with different climate zones thermal insulation requirements, comprising the steps of assembling a plurality of prefabricated building panels, wherein the prefabricated building panels each comprise a concrete slab having a thickness equal to or less than 2 inches, framing including a plurality of studs or beams permanently secured to the concrete slab with a spacing of 0.5 to 3.0 inches between the concrete slab and the framing, a continuous insulation which fills the spacing between the concrete slab and the framing, and a total insulation thickness equal to or greater than the spacing in compliance with predetermined energy code climate zones requirements, wherein each of the plurality of prefabricated building panels have identical properties in terms of concrete slab, framing, and continuous insulation, including total insulation thickness, selected and combined to achieve a specific thermal performance contained in the predetermined energy code climate zones requirements, and wherein a spacing between a concrete slab and a framing of some of the plurality of prefabricated building panels is adjusted larger than a spacing between a concrete slab and a framing of other panels of the plurality of prefabricated building panels to satisfy more stringent thermal insulation performance criteria contained in the predetermined energy code climate zones requirements.

11. The method of claim 10, wherein the framing is anchored to the concrete slab by a plurality of stainless steel anchors.

12. The method of claim 10, further comprising bolting or welding the assembled prefabricated building panels to building frames.

13. The method of claim 10, wherein the spacing for said some of the plurality of prefabricated building panels is at least 2 inches, and the spacing for said other panels is 1.5 inches.

14. The method of claim 10, wherein the continuous insulation extends between the webs of adjacent studs or beams of the framing.

15. The method of claim 10, wherein the thickness of the concrete slab is between 1.5 and 2 inches.

16. The method of claim 10, wherein said plurality of beams or studs are spaced apart at intervals of more than 2 feet and up to 4 feet.

17. The method of claim 10, wherein said width of each of said plurality of studs or beams is 4 to 6 inches.

18. The method of claim 10, wherein said plurality of studs or beams include C-shaped studs or beams.

19. A method for constructing exteriors of buildings to comply with different climate zones envelope thermal insulation requirements by adjusting a thermal break spacing, comprising the steps of assembling a plurality of prefabricated building panels, wherein the prefabricated building panels each comprise a concrete slab, framing including a plurality of studs or beams permanently secured to the concrete slab with a thermal break spacing of 0.5 to 3.0 inches between the concrete slab and the framing, a continuous insulation which fills the thermal break spacing between the concrete slab and the framing, and a total insulation thickness equal to or greater than the thermal break spacing, wherein each of the plurality of prefabricated building panels have identical properties in terms of concrete slab, framing, and continuous insulation, and wherein a thermal break spacing between a concrete slab and a framing of some panels of the plurality of prefabricated building panels is adjusted to be larger than a thermal break spacing between a concrete slab and a framing of other panels of the plurality of prefabricated building panels to satisfy more stringent envelope thermal insulation performance criteria.

* * * * *